US006116361A

United States Patent [19]

Kleine et al.

[11] Patent Number: 6,116,361

[45] Date of Patent: Sep. 12, 2000

[54] BORING TOOL

[75] Inventors: Werner Kleine, Achim; Udo Hauptmann, Munich; Harald Geiger, Kaufering; Anton Knoller, Landsberg; Josef Starkmann, Horlach, all of Germany

[73] Assignee: Hilti Aktiengesellschaft, Schaan, Liechtenstein

[21] Appl. No.: 09/252,191

[22] Filed: Feb. 18, 1999

[30] Foreign Application Priority Data

Feb. 21, 1998 [DE] Germany ..... 198 07 394

[51] Int. Cl.[7] ..... E21B 10/36

[52] U.S. Cl. ..... 175/415

[58] Field of Search ..... 175/269, 417, 175/415, 430, 420.1, 379, 429, 332, 431, 427, 398, 397; 408/145, 144, 223, 224

[56] References Cited

U.S. PATENT DOCUMENTS

| | | | |
|---|---|---|---|
| 3,773,122 | 11/1973 | Chromy | 175/385 |
| 4,903,787 | 2/1990 | Moser et al. | 175/415 X |
| 4,951,761 | 8/1990 | Peetz et al. | 175/415 X |
| 5,482,124 | 1/1996 | Haussmann et al. | 175/415 |
| 5,836,410 | 11/1998 | Kleine | 175/415 |
| 6,032,750 | 3/2000 | Kersten et al. | 175/398 |

FOREIGN PATENT DOCUMENTS

| | | |
|---|---|---|
| 3820695 | 12/1989 | Germany . |
| 2075409 | 11/1981 | United Kingdom . |

*Primary Examiner*—Robert E Pezzuto
*Attorney, Agent, or Firm*—Brown & Wood, LLP

[57] ABSTRACT

A drill including a shank (1) for connecting the drill with a drive tool, a stem (2) adjoining the shank (1) and having at most two helical discharge grooves (6, 7) opening toward a stem circumference, a head (3) provided at an end of the stem (2) remote from the shank (1) and having a diameter substantially corresponding to the stem diameter, with the head (3) having three radially extending recesses (8) provided in its free end surface and opening toward a head circumference, with the recesses being provided with at least one hard metal bit (9) provided with cutting portions **(9*a*) extending from a central portion (9*b*) to the head circumference, and with the head (3), having three grooves (10, 11, 12) arranged between the three recesses (8)**, opening toward the head circumference, and connected with the discharge grooves.

6 Claims, 1 Drawing Sheet

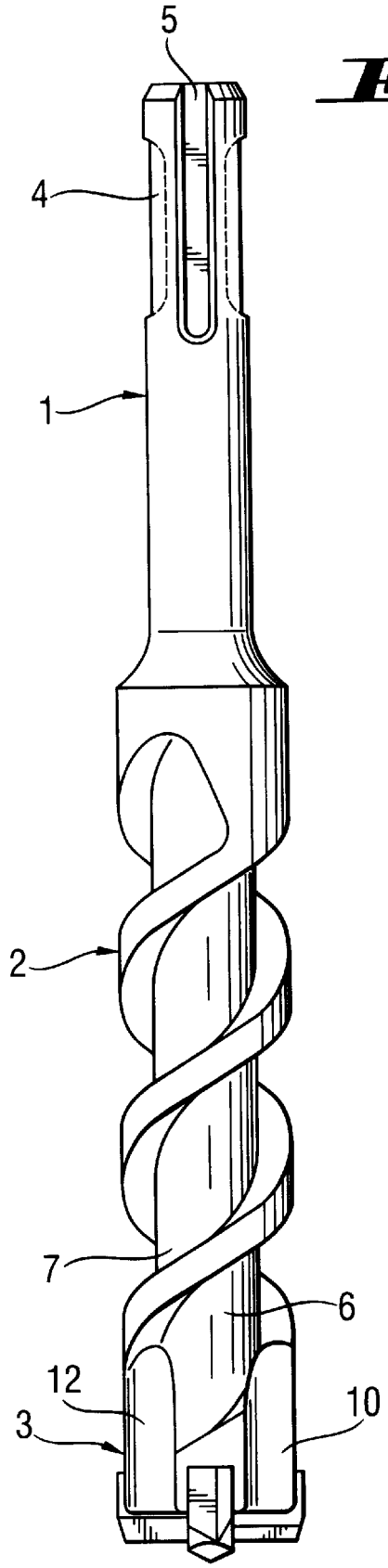
Fig. 1
Fig. 2
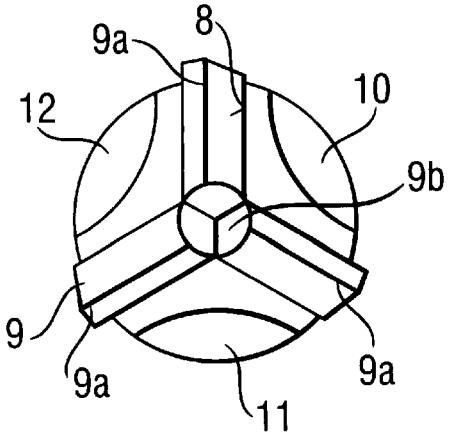

BORING TOOL

BACKGROUND OF THE INVENTION

1. Field of the Invention

The present invention related to a boring tool, in particular a drilling and/or chisel tool, including a shank for connecting the tool with a drive tool, a stem adjoining the shank and having helical discharge grooves opening toward a stem circumference, a head provided at an end of the stem remote from the shank and having a diameter substantially corresponding to the stem diameter, the head having three radially extending recesses provided in the free end surface thereof and opening toward a head circumference, the recesses being provided with at least one hard metal bit having cutting portions extending from a central portion to at least the head circumference, and three grooves arranged between the three recesses, respectively, opening toward the head circumference, and connected with respective discharge grooves.

2. Description of the Prior Art

A drilling and/or chisel tool, further simply drill, of the type described above is used primarily for forming bores in stone, concrete and brick work. The drill has, as it has been mentioned above, a shank adapted to be received in a chuck of a drive tool. Different types of drive tools can be used with the above-described boring tool, e.g., drill hammers, all-purpose hammer tools, and chisel hammers.

The drill further includes a stem adjoining the shank and having, as it has also been described above, helical discharge grooves open at the stem circumference. The discharge groove serves for removing drillings produced by a drilling head provided at the end of the stem remote from the shank.

For forming a bore, the drilling head is provided with one or more hard metal bits which slightly project beyond the free end of the head and are arranged in recesses formed in the end surface of the head and opening toward the free end of the head.

In the drills, hard metal bits with a star-shaped arrangement of the cutting portions particularly proved themselves. These bits have a centrally arranged central portion from which hard metal inserts extend radially in three direction at substantially the same angle toward each other and at least up to the circumference of the head. Such an arrangement of hard metal inserts or cutting portions advantageously increases the drilling capacity of the drill and permits to form a bore with precise dimensions. In addition, the star-shaped arrangement of the cutting inserts provides for a quite and substantially vibration-free operation of the drill.

The drills of the type described above, have grooves which are formed in the head between the recesses in which the cutting inserts are received. These grooves extend substantially parallel to the main axis of the drill and open at the circumference of the drill. These groove are necessary for transporting of the drillings to the discharge grooves. Because of the importance of the connection of the head grooves with the discharge grooves, in the known drills, the number of the head and discharge grooves is always the same, i.e., the drill with three head grooves always has three discharge grooves.

The need to form three discharge grooves limits the production processes which can be used for producing the drills. They are limited to machining and rolling processes. By themselves, these processes can be economical. However, to insure a further economy of these processes, additional expenses for developing the necessary technical equipment are necessary and which are not always available.

Accordingly, an object of the present invention is to provide a drill with the above-discussed advantageous arrangement of the hard metal inserts, which can be economically produced by a simple forming process.

SUMMARY OF THE INVENTION

This and other objects of the present invention, which will become apparent hereinafter, are achieved by providing a drill of the above-described type and having at most two discharge grooves.

Providing at most two discharge grooves in the above-described drill, permits to use a simple manufacturing process. In addition to the still available machining process, providing only two discharge grooves permits to use twist rollers for forming the drill. The advantage of using the twist rollers in comparison with the using of straight rollers consists in that they permit to improve the operational control while reducing expenses associated with the exploitation of the production machinery.

Providing at most of only two discharge grooves proved itself both from the manufacturing point of view and from the exploitation point of view. During manufacture, symmetrical and, thereby, easily controlled deformation forces are applied. During exploitation, i.e., during the formation of a bore, two discharge grooves provide for unproblematic and unhindered removal of drillings.

There exist different possibilities of connection of the discharge grooves with the head grooves. In an advantageous, particularly from the point of view of removal of drillings, embodiment of the drill according to the present invention, one of the two discharge grooves is connected with two head grooves. This embodiment not only has certain advantages from the point of view of manufacture and from the exploitation point of view, but also results in an extremely attractive shape of the drill head from the aesthetical point of view. The later feature is very important for an economical success of the inventive drill because an operator often judges the stability and the efficiency of a tool by its external appearance, and an attractive appearance thus inspire a certain confidence in the tool.

Further, the shape of the head affords further possibilities which advantageously influence removal of the drillings. In accordance with a further development of the present invention, at least one of the head grooves is connected with both discharge grooves. This is easily achieved by forming the corresponding groove with a length such that the groove intersects both discharge grooves.

It is advantageous, from the point of view of easy formation of the drill by application of uniformly distributed deformation forces, when the discharge grooves have the same cross-sectional surfaces.

According to another embodiment of the present invention, the discharge grooves can have different cross-sectional surfaces. This permits to form the discharge groove, which is connected with two head grooves, with a larger cross-sectional surface, so that both discharge grooves provides for an unhindered transportation of drillings.

In order not to impair a quite operation of the inventive drill, the head grooves have preferably substantially the same cross-sectional surfaces.

As discussed above, the drill head is provided with three recesses opening toward the free end of the head and in which the hard metal inserts are received. These recesses can be produced in different ways. E.g., they can be formed in the free end surface of the head extending along its entire diameter. They also can be formed as slots defining a star-shaped pattern. While using several hard metal inserts is possible, it is preferable to use a one-piece hard metal bit which, in correspondence with the arrangement of the recesses, can be formed as a star. When plurality of inserts are used, at least four parts become necessary, namely, a centrally arranged central part and three cutting parts arranged in a star-shaped pattern.

BRIEF DESCRIPTION OF THE DRAWINGS

The features and objects of the present invention will become more apparent, and the invention itself will be the best understood from the following detailed description for the preferred embodiments when read with reference to the accompanying drawings, wherein:

FIG. 1 shows a schematic side elevational view of a drill according to the present invention; and FIG. 2 shows a plan view of the drill head of the drill shown in FIG. 1.

DETAILED DESCRIPTION OF THE PREFERRED EMBODIMENT

A drill according to the present invention, which is shown in FIGS. 1–2, has a shank 1, a stem 2, and a head 3. The shank 1 is adapted to a chuck (not shown) of a drive tool and serves for connecting the drill with the drive tool. For connection with the chuck, the shank 1 is provided with axially closed locking grooves 4 and entraining grooves 5 axially open at one side.

The stem 2 has two discharge grooves 6 and 7 which are open at the drill circumference and have, in the shown embodiment, uniform cross-sectional surfaces.

The head 3 has a plurality of recesses 8 open at their free ends. As shown in FIG. 2, a hard metal bit 9 is arranged in the recesses 8. The hard metal bit 9 has a central portion 9*b* and three radially extending cutting portions 9*a* which are located in the recesses 8 and extend beyond the circumference of the head 3. Three grooves 10, 11 and 12, which extend parallel toward the main axis of the tool and are open toward the circumference of the head 3, extend, respectively, between radially extending cutting portions 9*a* of the bit 9. The grooves 10, 11, 12 are connected with the discharge grooves 6 and 7. In the embodiment shown in the drawings, the grooves 10 and 12 are connected with the discharge groove 6, and the groove 11 is connected with a discharge groove 7.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A drill, comprising a shank (1) for connecting the drill with a drive tool; a stem (2) adjoining the shank (1) and having two helical discharge grooves (6, 7) opening toward a stem circumference; and a head (3) provided at an end of the stem (2) remote from the shank (1) and having a diameter substantially corresponding to the stem diameter, the head (3) having three radially extending recesses (8) provided in a free end surface thereof and opening toward a head circumference, the recesses (8) being provided with at least one hard metal bit (9) provided with cutting portions (9*a*) extending from a central portion (9*b*) to the circumference of the head (3), the head (3) having three grooves (10, 11, 12) arranged between the three recesses (8), opening toward the head circumference, and connected with the discharge grooves.

2. A drill according to claim 1, wherein the three grooves (10, 11, 12) formed in the head (3), have substantially same cross-sectional surfaces.

3. A drill according to claim 1, wherein one (6) of the at most two discharge grooves is connected with two (10, 12) of the three grooves provided in the head.

4. A drill according to claim 1, wherein at least one of the three grooves (10, 11, 12) provided in the head (3) is connected with both discharge grooves (6, 7).

5. A drill according to claim 1, wherein the at most two discharge grooves (6, 7) have the same cross-sectional surface.

6. A drill according to claim 1, wherein the at most two discharge grooves (6, 7) have, respectively, different cross-sectional surfaces.

* * * * *